United States Patent [19]

Anderson

[11] Patent Number: 4,805,735

[45] Date of Patent: Feb. 21, 1989

[54] SCAFFOLDING NET SYSTEM

[76] Inventor: Carl Anderson, 2589 Richmond Ter., Staten Island, N.Y. 10303

[21] Appl. No.: 160,656

[22] Filed: Feb. 28, 1988

[51] Int. Cl.[4] ..... E04G 1/26

[52] U.S. Cl. ..... 182/138; 182/129; 52/63

[58] Field of Search ..... 182/137, 138, 139, 140, 182/47, 129; 52/63

[56] References Cited

U.S. PATENT DOCUMENTS

| | | | |
|---|---|---|---|
| 3,392,801 | 7/1968 | Gethmann | 182/132 |
| 3,533,487 | 10/1970 | Norin | 182/138 |
| 3,949,834 | 4/1976 | Nusbaum | 182/138 |
| 3,995,715 | 12/1976 | Virtanen | 182/47 |
| 4,119,176 | 10/1978 | Verdu | 182/138 |
| 4,129,197 | 12/1978 | Preston | 182/138 |
| 4,574,534 | 3/1986 | Beaton | 52/63 |
| 4,598,794 | 7/1986 | Anderson | 182/113 |
| 4,732,234 | 3/1988 | Brickman | 182/138 |
| 4,738,335 | 4/1988 | Ishii | 182/138 |

*Primary Examiner*—Reinaldo P. Machado
*Attorney, Agent, or Firm*—Helfgott & Karas

[57] ABSTRACT

A guard system for a scaffolding arrangement having upper and lower platforms traversing a pair of spaced apart poles. The platforms respectively project from opposing directions of a plane defined by the poles. The guard system includes a net wall which spans the gap between the upper and lower platforms. A clamping arrangement clamps the upper edge of the net wall to the upper platform and a lower edge of the net wall to the lower platform.

22 Claims, 3 Drawing Sheets

SCAFFOLDING NET SYSTEM

RELATIONSHIP TO OTHER APPLICATIONS

This invention relates to the following issued and pending U.S. applications, all by the inventor of the present application: U.S. Pat. No. 4,382,488 issued May 10, 1983 for PUMP JACK POLES; U.S. Pat. No. 4,432,435 issued Feb. 21, 1984 for CLAMPING DEVICE; U.S. Pat. No. 4,446,945 issued May 8, 1984 for a BRACE FOR SECURING A POLE TO A SUPPORT SURFACE; U.S. Pat. No. 4,463,828 issued Aug. 7, 1984 for a PUMP JACK; U.S. Pat No. 4,499,967 issued Feb. 19, 1985 for SCAFFOLDING STAGING, and U.S. Pat. No. 4,598,784 issued July 8, 1986 for SCAFFOLDING SYSTEM.

BACKGROUND OF THE INVENTION

This invention relates to scaffolding systems, and more particularly to a scaffolding arrangement supported on pump jack poles on which are arranged pump jacks for riding up and down the poles.

In various industrial applications, scaffolding is erected in order to give workers access to elevations above a ground surface. By way of example, in the installation of aluminum siding along the exterior of housing, scaffolding is required to permit workers to move up and down adjacent the side of the housing in order to install housing siding. In such cases, the scaffolding is typically erected through the use of pump jack poles which are spaced apart along the side of the house and secured to the house by means of braces. Pump jacks are then utilized to ride up and down the poles. The pump jacks typically include support arms on which are placed scaffolding staging. The workers can stand on the scaffolding staging and operate the pump jacks to move the staging up and down along the pump jack poles.

The aforementioned U.S. Pat. No. 4,382,488 describes a novel pump jack pole formed of elongated hollow metal with a rubberized surface formed on only one side of the metal pole. Such poles were found to be extremely strong, long-lasting, and easier to manipulate than the previously standard wooden poles. An improved brace was described in U.S. Pat. No. 4,446,845 for connecting the pump jack pole to a support surface such as the wall or roof of a housing. A clamp, such as is described in the U.S. Pat. No. 4,432,435 can be used to interconnect the brace to the pole. A pump jack is described in U.S. Pat. No. 4,463,828 and includes improved features for safety purposes and for increased strength. An arrangement is described in U.S. Pat. No. 4,499,967 for interconnecting two elongated staging sections to permit co-linear and co-planar connection of the sections.

The pump jack described in the aforementioned patent, includes a lower arm on which the scaffolding is supported with the scaffolding facing in one direction with respect to the poles. Typically, the scaffolding platform will be oriented in a direction facing from the poles toward the housing. The aforedescribed pump jacks also include an upper arm on which can be placed another platform which can be used as a work bench. In fact, the standard scaffold staging which is used as a platform on the lower arms, can actually be inverted when placed on the upper arms and will provide for a deep trough which can be used as a work bench for storing supplies. The spacing between the lower arms and the upper arms is such that an individual standing on the staging platform on the lower arms can easily reach into the work bench on the upper arm.

In utilizing such arrangement, the space between the upper and lower layers of scaffolding staging is generally open and can result in accidental falling of the worker between the layers. Additionally, the possibility of having tools fall also exist. Tools falling off provides both an inconvenience, and it can also be a danger to anyone standing beneath the staging on the floor below. One solution to such a safety problem is presented in the aforemention U.S. Pat. No. 4,598,794. In such patent, there is described a side rail system for interconnecting layered sections of elongated scaffold staging. The side rail system includes upright posts, which are spaced along the staging. A pair of rods are respectively associated with the top and bottom of each post. The rods are pivotally connected to the posts and are inserted into the upper and lower layers of the staging and secured by means of quick connect arrangements. A mid rail as well as a toe board can then be horizontally connected to the rails. An end rail system is also described.

While such side rail system has been found to be extremely effective and providing a safety improvement, other safety arrangements would appear useful as well.

SUMMARY OF THE INVENTION

Accordingly, it is an object of the present invention to provide a guard system for a scaffolding arrangement having upper and lower platforms with the guard system spanning the open space between the upper and lower platforms.

Another object of the present invention is to provide a safety net system, which can be used to close off a vertical spacing between layers of platforms in a scaffolding arrangement.

Still another object of the present invention is to provide a scaffolding arrangement with upper and lower platforms and including a flexible wall system spanning between the platform layers to provide a safe interconnection between the layered platforms.

A further object of the present invention is to provide a guard system for layers of scaffolding staging positioned on upper and lower arms of pump jacks riding up and down pump jack poles.

Briefly, in accordance with the present invention, there is provided a guard system for a scaffolding arrangement having upper and lower platforms. The platforms respectively traverse a pair of spaced apart poles. The platforms respectively project from opposing directions of a plane and defined by these poles. The guard system includes a net which spans the gap between the upper and lower platforms. A clamping arrangement is provided for clamping an upper edge of the net to the upper platform and a lower edge of the net to the lower platform.

The present invention also contemplates a scaffolding arrangement including at least two horizontally spaced apart vertical poles with a pair of vertically spaced apart substantially horizontal platforms spanning between the poles. Each of the platforms extend in opposite directions from a plane defined by the poles. A flexible wall extends between the platforms in a substantially vertical direction. A coupling removably secures opposing upper and lower edges of the flexible wall to the respective platforms.

The aforementioned objects, features and advantages of the present invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing like reference characters designate like parts.

DESCRIPTION OF THE PREFERRED EMBODIMENT

Figure 1:
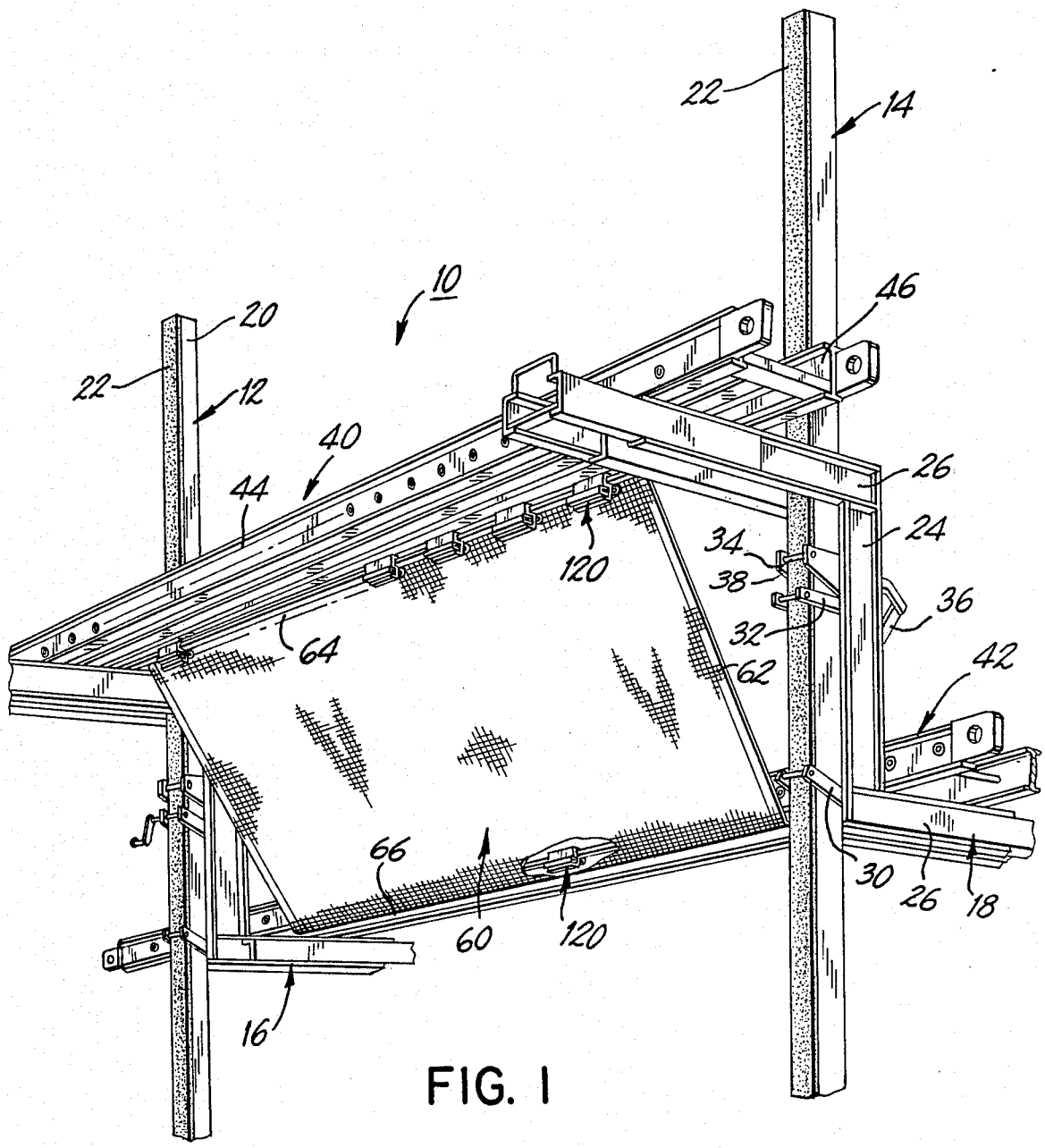
FIG. 1 is a perspective view of a scaffolding arrangement in accordance with the present invention showing the use of the guard system for interconnecting layered sections of elongated scaffolding staging supported on pump jacks and riding on pump jack poles.
Figure 2:
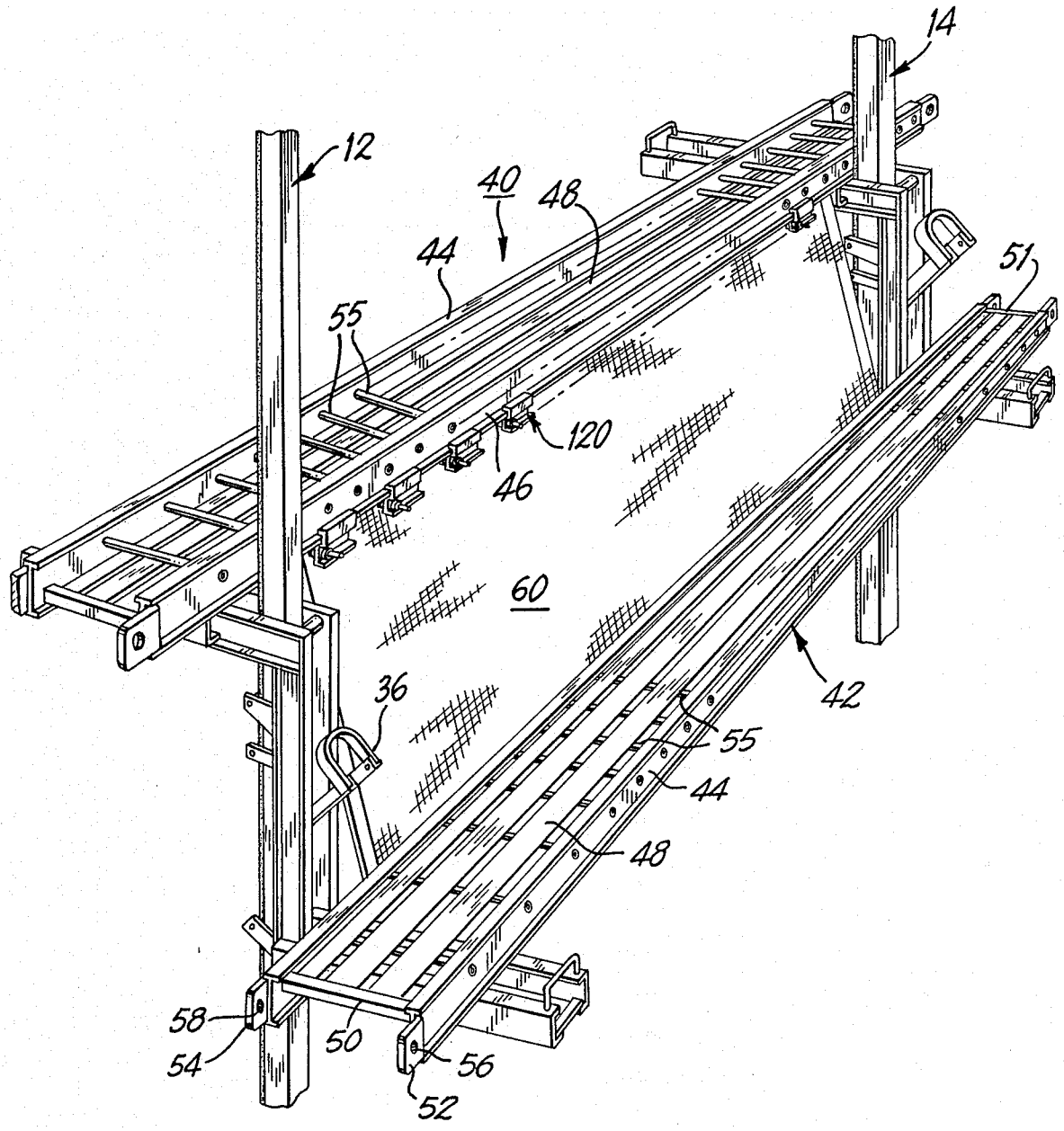
FIG. 2 is a perspective view of the scaffolding arrangement shown in FIG. 1, and taken from the inside of the scaffolding staging.

Referring now to FIGS. 1 & 2, there is shown a scaffolding system 10, having a pair of spaced apart pump jack poles 12, 14 on which there rides respective pump jacks 16, 18. The pump jack poles 12, 14 are shown to be those described in U.S. Pat. No. 4,382,488. More specifically, each is a substantially rectangular hollow metal pole 20, on which is placed a rubberized surface 22 on one side thereof. Such pump jack poles have been found to be easier to utilize, stronger, longer-lasting, and more efficient than wooden poles.

The pump jacks 16, 18 can be of a type which operates as that described in U.S. Pat. No. 4,463,828. More specifically, the pump jack comprises an upright frame portion 24 on which is provided an upper support arm 26 and a lower support arm 28. The pump jack includes a lower shackle portion 30 and an upper shackle portion 32, both of which surround the pump jack pole. An upper roller portion 34 also surrounds the pole. By means of the pumping arm 36, the pump jack is stepped up the pump jack pole. The over-the-center spring-loaded handle 38 is operated to roll the pump jack down the pole.

Two substantially identical staging sections of scaffolding 40 & 42, are provided to form the scaffolding platform. The upper section 40 is spanned between the upper arms 26 of the pump jacks 16, 18. The lower staging section 42 is supported between the support arms 28 of the pump jacks 16, 18. Since the support arms project in opposing directions, the staging sections will be layered one above the other and will project in opposing directions from a common plane defined by the poles 12 & 14.

Each of the staging sections 40, 42 are formed of a pair of opposing side rails 44, 46 formed of I-shaped beams and referred to as I-rails. These support a series of slats 48 secured at their opposing ends by means of the bars 50, 51. A plurality of spaced apart hollow lugs 55 secure the oposing side rails 44, 46 in opposition and support the slats 48 to form the platform. At each end of the staging section there are provided ears 52, 54 which can be fastened to the I-rails providing termination of the staging sections. Aligned apertures 56, 58 are provided in the ears 52, 54 for coupling together adjacent staging sections as described in U.S. Pat. No. 4,499,967.

It will be noted, that the lower platform 42 is positioned in its normal position with the slats 48 facing upwardly in order to provide a work platform on which workers can stand. The upper staging section 40 is inverted with the slats 48 facing downward. The lugs 55 are accessible and serve to space apart the opposing I-rails 44, 46. In this manner, the upper section serves as a work bench wherein tools, equipment, and the like can be placed as the workers stand on the lower platform.

As will be appreciated, with the staging sections positioned on the support arms of the pump jacks, the vertical spacing therebetween is normally empty, whereby workers on the lower platform can accidentally slip off the platform. Additionally, while working with equipment placed on the lower platform, or while holding the equipment in hand, there is a possibility that equipment, or tools, or other material can fall through the space between the upper and lower platforms 40, 42. This spacing which normally exists between the layers of the platform staging has been one of extreme dangerous condition when utilizing scaffolding platforms.

In order to provide a guard system for such a scaffolding arrangement, the present invention provides for a flexible wall in the form of a net 60 which spans the vertical space between the upper and lower platforms 40, 42. The material is of sufficient strength to meet safety standards and sufficient for static load requirements. The mesh net wall 60 is shown to include a side hem 62 thereabout, as well as an upper hemmed edge 64 and a lower hemmed edge 66. Because the upper and lower platforms are spaced in opposing directions from the common plane defined between the poles 12, 14, the confronting I-rails of the upper and lower platforms are actually spaced apart. Accordingly, the wall 60 is in a vertical direction but slightly angled, as best shown in FIGS. 1 and 2. If desired, an advertising statement, such as the name of the manufacturer, can actually be placed along the exterior of the flexible wall 60, as shown in FIG. 1, to provide an advertising benefit to the installer or manufacturer.

Because of the flexibility of the wall, as the pump jack moves up and down, the wall can bend along with the movement and will reposition itself after the platforms are reoriented. The wall is sufficiently strong so that a person falling against it will be retained in place and not permit him to slip to lower levels. Likewise, tools, equipment, and the like falling against it will also be prevented from being lost and will easily be retrieved.

Figure 3:
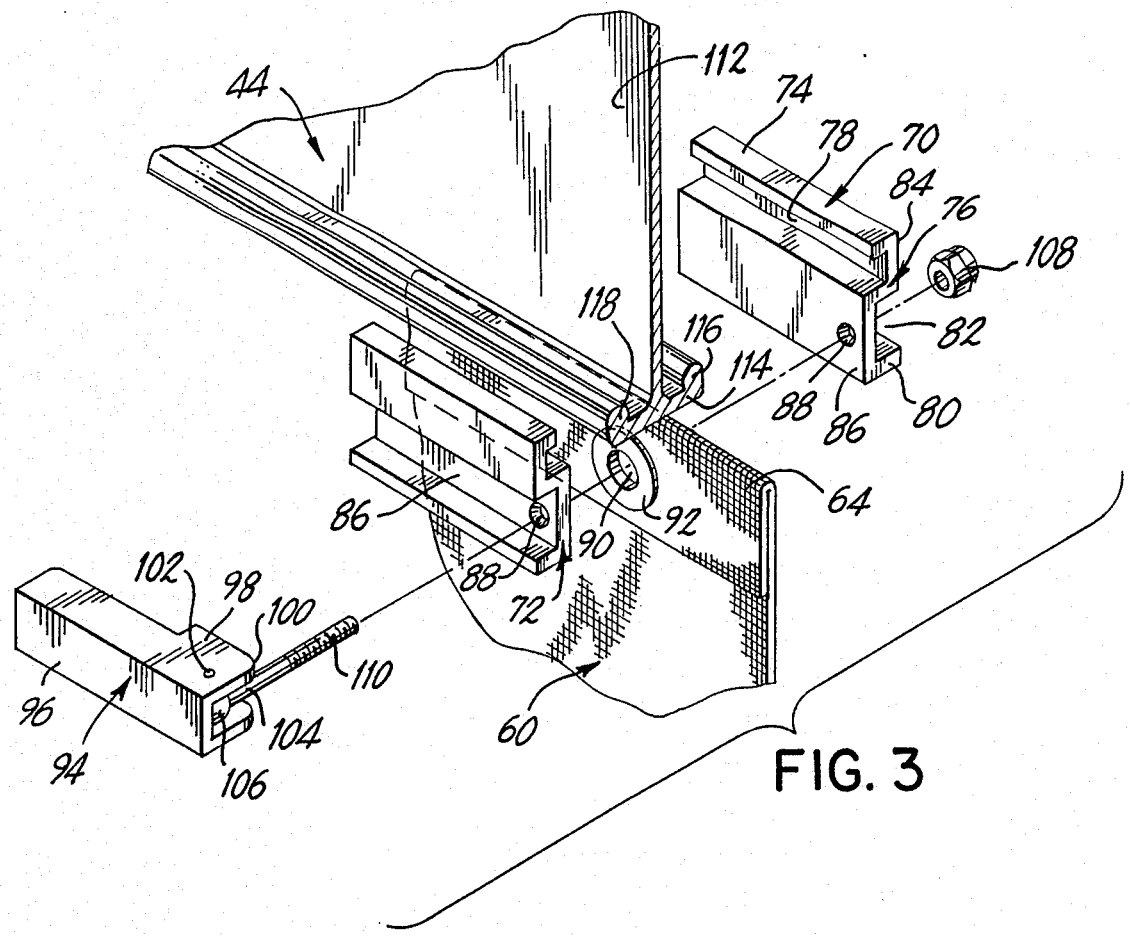
FIG. 3 is an exploded view of the coupling arrangement for interconnecting the net wall to the I-rail of the staging platform, in accordance with a first embodiment over the present invention.
Figure 4:
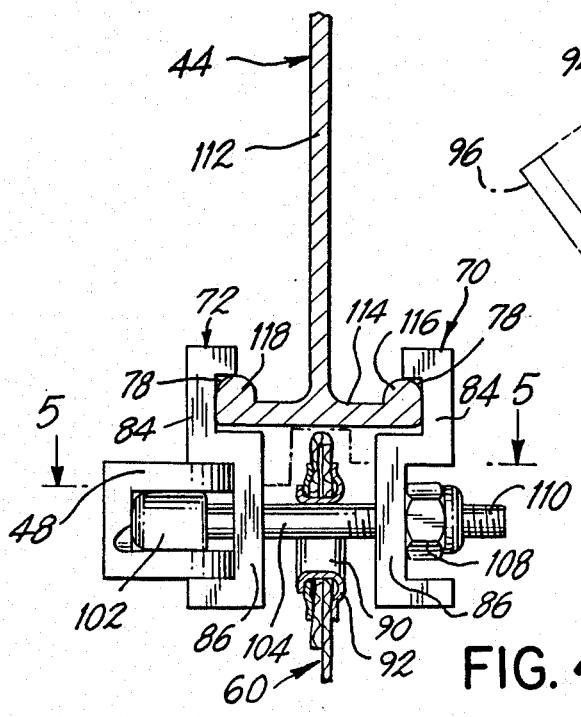
FIG. 4 is an end-view of the coupling arrangement shown in FIG. 4.
Figure 5:
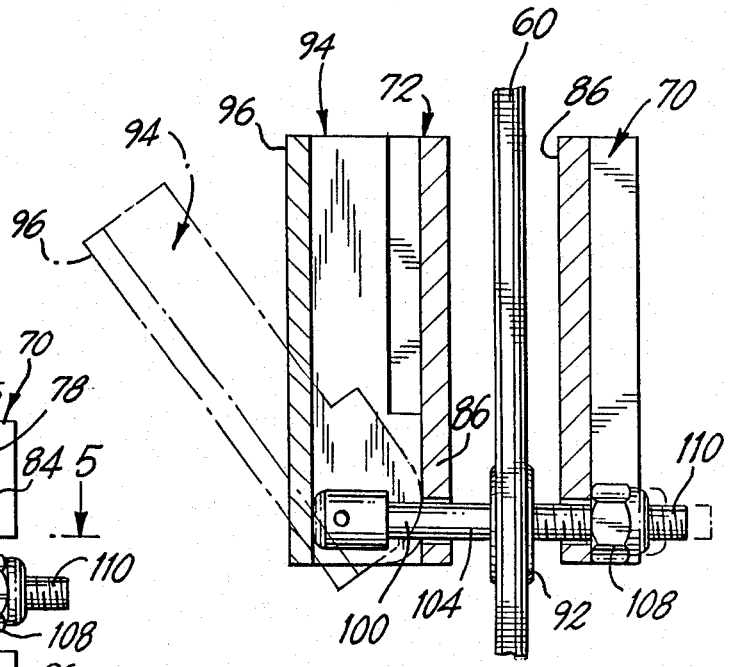
FIG. 5 is a cross-sectional view taken along lines 5—5 of FIG. 4.

The net wall is retained onto the upper and lower platforms by means of clamping arrangements. Referring now to FIGS. 3–5, one type of clamping arrangement is shown. The clamping arrangement comprises a pair of side arms 70, 71 of substantially identical configuration. Each arm consists of a substantially S-shaped configuration, having an upper wall 74 with an intermediate wall 76 spaced apart and defining a cavity 78. A lower wall 80 together with the intermediate wall 76 defines a further cavity 82. Rearward of cavity 78 is the back wall 84 and rearward of the cavity 82 is back wall 86. The back wall 86 of the arm member 70 and the corresponding back wall 86 of the arm member 72 have aligned apertures 88.

It will be noted, that along the upper edge 64 of the net wall 60 there are provided a plurality of apertures 90 with grommets 92 therearound. These apertures with surrounding grommets would be spaced apart along the entire upper hem 64 and likewise, along the entire bottom hem 66.

A clamping lever 94 is provided with an arm portion 96 terminating in a projecting head 98 with a rounded cam surface 100 at its corner edge. Pivoted between the upper and lower faces of the head 98 by means of pivot pin 102 is an elongated post 104 having an enlarged head 106 passing through the pivot pin 102. A locking bolt 108 is provided for threading onto the lower end threaded portion 110 of the post 104.

The I-rail 44 is shown to include a web portion 112 with a lower perpendicular flange 114. The side distal ends of the flange terminate in upwardly projecting ridges 116, 118.

As best seen in FIGS. 4 and 5, the clamping arrangement is such that the cavities 78 of the opposing arms 70, 72 receive the opposing distal ridges 116, 118 of the flange portion 114 of the I-beam 44. The post 104 passes through the aligned apertures 88 in the walls 86 and sandwich there between the mesh wall 60 by passing through the aperture 90 in the grommet 92. By closing the arm 96, as best seen in FIG. 5, the cam surface 100 presses against the walls 86 thereby clamping the two arms onto the flange of the I-rail and securing the mesh wall 60 directly adjacent to the I-rail.

Initially, the spacing of the nut 108 is located at a position along the threaded post 104 so that in the locked position of the lever 94, the arms 70, 72 will be tightly secured onto the I-rail.

The installation of the net is easily achieved. As shown in FIG. 1, a plurality of the clamps 120 are spaced along the length of the upper edge 64 and the lower edge 66. The clamps 120 are positioned at each of the grommet positions. Likewise, they are spaced along the lower edge. These clamps secure the net to the bottom of the upper I-rail and the bottom of the lower I-rail.

Figure 6:
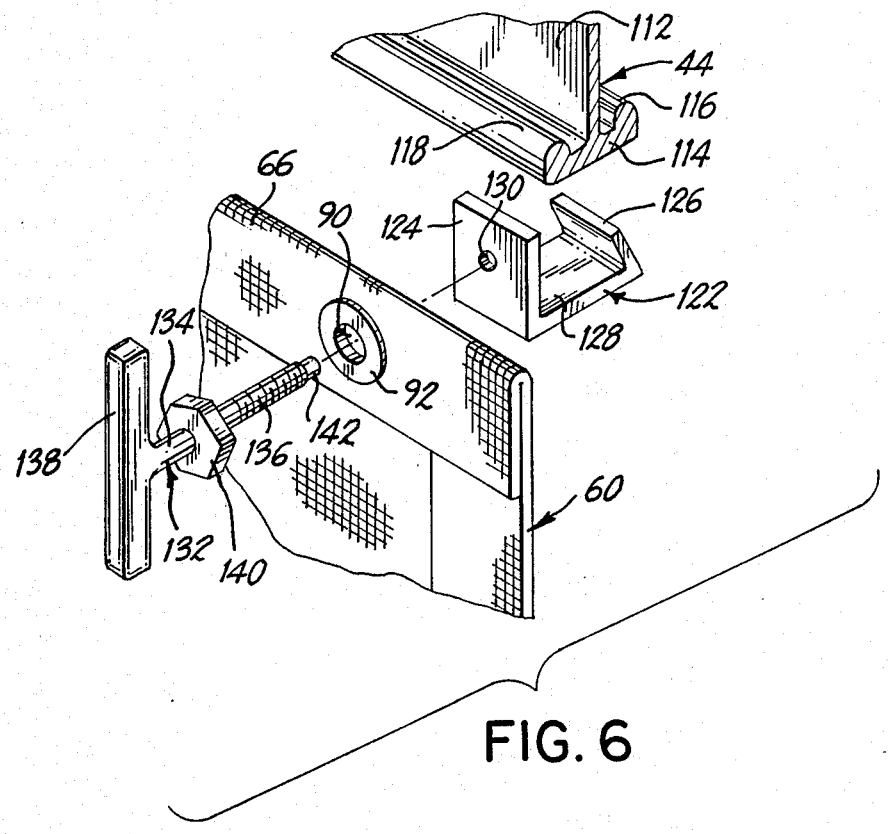
FIG. 6 is an exploded perspective view of another form of the clamping arrangement.
Figure 7:
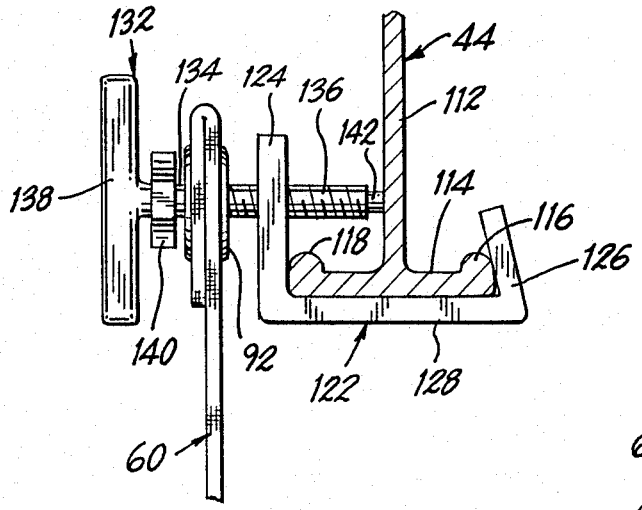
FIG. 7 is an end-view of the clamping arrangement shown in FIG. 6.

FIGS. 6–7 show yet another clamping arrangement for securing the net wall 60 to the I-rail 44. In this case the clamp comprises a substantially U-shaped member 122 having a pair of opposing legs 124, 126 interconnected by an interconnecting lower wall 128. The wall 124 extends Substantially vertically and includes an aperture 130. The opposing wall 126 is shorter than wall 124 and bends inwardly.

A clamping screw 132 includes a stem 134 with a threaded end 136 and a substantially perpendicular handle 138 to provide a T-arrangement. A nut 140 is placed along the stem 132.

As best seen in FIG. 7, the threaded post 134 passes through the aperture 90 in the grommet 92 of the mesh wall 60 and then extends through the aperture 130 in the leg 124. The bottom interconnecting wall 128 of the clamping member 122 is spaced such that it corresponds to the length of the flange at the bottom of the I-rail. In this way, the opposing legs 126, 124 are situated snugly on either side of the ridges 116, 118. The leg 126 moves inwardly so as to tightly grip the ridge 116. By tightening the clamp 132 by means of the handle 138 a pilot portion 140 engages the web portion 112 of the I-rail and tightly clamps the mesh wall in place against the I-rail. The nut 140 keeps the net close to the I-rail minimizing objects falling between the I-rail and the net.

Figure 8:
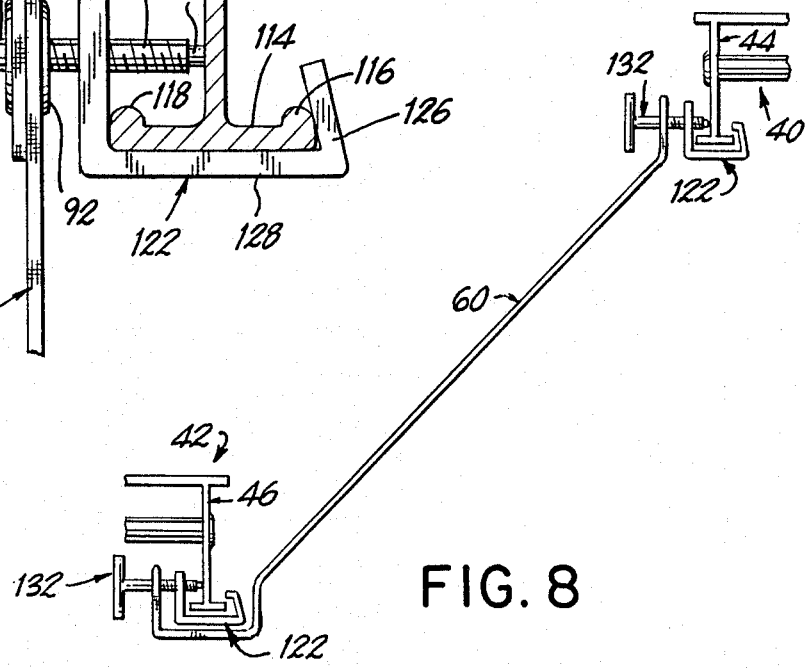
FIG. 8 is a schematic view showing the net interconnected between upper and lower platforms with the net wrapped around the I-rail of one of the platforms.

In order to further tighten the space and, in fact eliminate any space between the net and the I-rail, as shown in FIG. 8, the net 60 can be extended around the bottom of the I-rail 46, and completely wrap around to the underside of the clamping portion 122. The screw handle 132 is then clamped from the inside of the lower platform 42. As a result, there is no open space between the net wall 60 and the lower platform whereby any tool that may happen to drop cannot fall but is captured by the wrapped around portion of the net wall. In the case of the upper platform 40, the clamping arrangement can be placed from the outside of the I-rail since there is no problem of items falling in between since workers only stand on the lower platform 42. This wraparound also prevents any workers' foot from getting caught should he slip between the net and the I-rail. Furthermore, because of the wraparound, the net becomes so strong that the worker can now actually stand between the net and the I-rail, although such would normally not be done.

Although a workbench has been shown on the upper arms, an I-rail itself could be used. Additionally, any other rail could be used.

There has been disclosed heretofore the best embodiment of the invention presently contemplated. However, it is to be understood that various changes and modifications may be made thereto without departing from the spirit of the invention.

What I claim is:

1. A guard system for a scaffolding arrangement having upper and lower sections respectively traversing a pair of spaced apart poles, the sections respectively located on opposing directions of a plane defined by the poles, said guard system comprising net means spanning the gap between said upper and lower sections, and clamping means for clamping an upper edge of the net means to the upper sections and a lower edge of the net means to the lower section.

2. A guard system as in claim 1, wherein said lower section is a staging platform.

3. A guard system as in claim 1, wherein said upper section is a workbench.

4. A guard system as in claim 1, wherein said net means is of a flexible mesh material.

5. A guard system as in claim 4, and wherein said mesh material proximately extends in length between said poles.

6. A guard system as in claim 1, wherein said net means comprises a plurality of grommets spaced along the upper and lower edges thereof, and wherein said clamping means comprises posts extending through said grommets.

7. A guard system as in claim 1, wherein said upper and lower sections include an I-rail having a web portion and top and bottom flanges, and wherein said means for clamping secures on to said I-rail.

8. A guard system as in claim 5, wherein said clamping means comprises a pair of arm members for sandwiching a flange of the I-rail, a post loosely extending through an edge of said net means and through said pair of arm members, locking means for preventing removal of the pair of arm members from said post, and lever means pivotally coupled to said post for clamping the pair of arm members in position on either side of the flange.

9. A guard system as in claim 8, wherein said arm members are substantially identical.

10. A guard system as in claim 7, wherein said clamping means comprises a U-shaped member having a pair of opposing legs and an interconnecting bight portion, said legs grasping on either side of a flange of the I-rail, a threaded aperture in one of said legs, and a threaded post for insertion through an edge of the net means and clamping on to the web portion of the I-rail.

11. A guard system as in claim 10 wherein the other leg has its distal end inwardly bent.

12. A scaffolding arrangement comprising at least two horizontally spaced apart vertical poles, a pair of vertically spaced apart scaffold sections spanning between said poles, each section extending in opposite directions from a plane defined by said poles, a flexible wall member extending between said sections in a substantially vertical direction, and coupling means for removably securing opposing upper and lower edges of said flexible wall to respective sections.

13. A scaffolding arrangement as in claim 12, wherein said flexible wall comprises a net.

14. A scaffolding arrangement as in claim 13, and comprising spaced apart grommets along the upper and lower edges of the net.

15. A scaffolding arrangement as in claim 12, wherein said upper and lower sections are spaced from said plane, whereby said flexible wall is angularly oriented.

16. A scaffolding arrangement as in claim 12, wherein an upper one of said sections is a workbench, and a lower one of said sections is a work platform.

17. A scaffolding arrangement as in claim 12, wherein said sections include an I-rail having a web portion and top and bottom flanges, and wherein said coupling means secures to one of said flanges.

18. A scaffolding arrangement as in claim 17, wherein said coupling means comprise a pair of clamping arm members for sandwiching a flange of the I-rail, post means loosely extending through an edge of said flexible wall and through said pair of clamping arm members, locking means for preventing removal of the pair of clamping arm members from said post means, and lever means pivotally coupled to said post means for clamping the pair of clamping arm members in position on either side of the flange.

19. A scaffolding arrangement as in claim 17, wherein said clamping means comprises a U-shaped member having a pair of opposing legs and an interconnecting bight portion, said legs grasping on either side of a flange of the I-rail, a threaded aperture in one of said legs, and a threaded post for insertion through an edge of the net means and through said threaded aperture and clamping on to the web portion of the I-beam.

20. A scaffolding arrangement as in claim 19, wherein the other leg has its distal end inwardly bent.

21. A scaffolding arrangement as in claim 17, wherein the lower edge of the flexible wall wraps around the flange of a lower one of the sections to thereby close off any space between the flexible wall and the lower platform.

22. A scaffolding arrangement as in claim 12, wherein said poles are pump jack poles, and further comprising pump jacks on each pole, said pump jacks supporting said platforms.

* * * * *